US008118242B2

(12) United States Patent
Clavelle

(10) Patent No.: US 8,118,242 B2
(45) Date of Patent: Feb. 21, 2012

(54) WASH ARM RETAINER FOR WAREWASHER

(75) Inventor: Adam T. Clavelle, San Francisco, CA (US)

(73) Assignee: Illinois Tool Works Inc., Glenview, IL (US)

( * ) Notice: Subject to any disclaimer, the term of this patent is extended or adjusted under 35 U.S.C. 154(b) by 178 days.

(21) Appl. No.: 11/657,499

(22) Filed: Jan. 24, 2007

(65) Prior Publication Data

US 2008/0173730 A1 Jul. 24, 2008

(51) Int. Cl.

| | |
|---|---|
| ***B05B 3/06*** | (2006.01) |
| ***B05B 3/02*** | (2006.01) |
| ***B05B 3/00*** | (2006.01) |
| ***B05B 1/32*** | (2006.01) |
| ***B05B 1/18*** | (2006.01) |
| ***F23D 11/04*** | (2006.01) |
| ***B25B 1/10*** | (2006.01) |
| ***B25B 1/08*** | (2006.01) |
| ***B25B 1/06*** | (2006.01) |

(52) U.S. Cl. ..... 239/261; 239/220; 239/222; 239/265; 239/255; 239/457; 239/567; 269/246; 269/229; 269/254 CS

(58) Field of Classification Search ..... 239/225.1, 239/261, 600, 566, 437, 457, 551, 104, 214, 239/220, 222, 251, 263.1, 264, 265, 567, 239/283, 587.5, 255; 134/201; 211/8, 4, 211/17; 248/229.11, 229.21, 231.21, 231.31, 248/230.2, 228.2; 403/110, 350, 322.4; 16/322, 16/324, 325, 326, 334, 349; 269/43, 71, 269/254 CS, 246, 236

See application file for complete search history.

(56) References Cited

U.S. PATENT DOCUMENTS

| | | | | | |
|---|---|---|---|---|---|
| 1,406,465 | A | * | 2/1922 | Lynch | 134/72 |
| 2,993,338 | A | * | 7/1961 | Wilsted | 60/739 |
| 3,101,730 | A | * | 8/1963 | Harris et al. | 134/167 R |
| 3,141,618 | A | | 7/1964 | Haas | |
| 3,424,442 | A | * | 1/1969 | Greenfield | 261/81 |
| 3,443,568 | A | * | 5/1969 | Janiszewski | 134/199 |
| 3,568,935 | A | * | 3/1971 | Hoffman | 239/568 |
| 4,014,467 | A | * | 3/1977 | Ferguson | 239/261 |
| 4,185,781 | A | | 1/1980 | O'Brien | 239/600 |
| 4,257,559 | A | * | 3/1981 | Noren | 239/283 |
| 4,582,259 | A | | 4/1986 | Hoover et al. | 239/559 |
| 4,657,188 | A | | 4/1987 | Crane et al. | 239/557 |
| 4,735,222 | A | | 4/1988 | Crane et al. | 134/172 |
| 4,915,305 | A | | 4/1990 | O'Brien et al. | 239/550 |

(Continued)

FOREIGN PATENT DOCUMENTS

EP 1 523 927 A2 4/2005

(Continued)

*Primary Examiner* — Jason J Boeckmann
*Assistant Examiner* — Steven M Cernoch
(74) *Attorney, Agent, or Firm* — Greer, Burns & Crain, Ltd.; Maurice Finnegan, III; Mark W. Croll

(57) ABSTRACT

A wash arm retainer for a warewasher having at least one wash arm with a plurality of nozzles and being in fluid communication with an adapter for receiving a flow of fluid, includes a housing defining a through bore and having a first end and a second end, a cam surface formed in the housing and having a clamping position and a release position, and a cap rod slidably disposed in the through bore and provided with an actuator handle projecting from the rod and constructed and arranged for following the cam surface.

17 Claims, 4 Drawing Sheets

U.S. PATENT DOCUMENTS

| | | | | | |
|---|---|---|---|---|---|
| 5,190,224 | A | | 3/1993 | Hamilton | 239/600 |
| 5,282,575 | A | * | 2/1994 | Krulick et al. | 239/255 |
| 5,333,790 | A | | 8/1994 | Christopher | 239/391 |
| 5,564,448 | A | * | 10/1996 | Lincoln | 134/166 R |
| 5,692,734 | A | * | 12/1997 | Aldredge, Sr. | 269/166 |
| 5,727,739 | A | | 3/1998 | Hamilton | 239/600 |
| 5,927,616 | A | * | 7/1999 | Grise et al. | 239/600 |
| 6,079,638 | A | * | 6/2000 | Chang | 239/390 |
| 7,083,121 | B2 | * | 8/2006 | Huffman | 239/398 |
| 2005/0055805 | A1 | * | 3/2005 | Hsu et al. | 16/324 |
| 2005/0081897 | A1 | * | 4/2005 | Pardini | 134/58 D |

FOREIGN PATENT DOCUMENTS

| | | | |
|---|---|---|---|
| EP | 1523927 | A2 * | 4/2005 |

* cited by examiner

WASH ARM RETAINER FOR WAREWASHER

BACKGROUND OF THE INVENTION

The present invention relates to a commercial warewasher or dishwasher, and more specifically to an apparatus for facilitating removal of the wash arm.

Commercial warewashers typically employ a wash arm or nozzle-equipped manifold for spraying water at high temperature and pressure at target dishware. Such machines recycle the wash water, so that food particles are often included in the high pressure flow. Often dislodged particles collect on the wash arm and other washer components, and when exposed to the soapy water, heat and humidity of the interior of the machine, a residue forms on the wash arm and other components. Thus, the wash arm ideally is removed for cleaning on a regular basis to maintain operational efficiency of the warewasher. In heavy commercial use situations, daily cleaning is recommended.

U.S. Pat. No. 4,257,559 describes a conventional mechanism for removing the wash arm including a threaded closure cap which is mounted on a threaded rod which is coaxial with the wash arm. To remove the wash arm, the operator backs off the closure cap from the rod to create a clearance between the cap and the corresponding wash arm end. The clearance allows the removal of the wash arm. However, it has been found that the accumulated grime in the machine makes it difficult for the operator to move the cap after use, and grime often clogs the threads. Also, the configuration of the cap is not conducive to positive gripping by the operator. Thus, tools are often required to free the cap for efficient wash arm removal. Because of the difficulty in removing the wash arms, they may not be cleaned as frequently as recommended.

Another approach to removing the wash arm is disclosed in U.S. Pat. No. 5,927,616. A spring-biased rod exerts an axial clamping force on the wash or rinse arm (the terms are used interchangeably) during operation. When arm removal is desired, a "T"-shaped handle is used to retract a clamping rod against the spring force. The handle is pulled to a temporary open or retracted position where the spring is compressed, releasing clamping pressure on the wash arm and enabling removal. However, since the spring is exposed to the washing chamber of the warewasher, it is subject to becoming covered with grime, which interferes with retraction.

Thus there is a need for an improved apparatus for easily removing a wash arm from a warewasher, and which provides sufficient clamping force for holding the wash arm in an operational position. There is also a need for such an improved wash arm retainer which is less susceptible to accumulation of grime than conventional units.

BRIEF SUMMARY OF THE INVENTION

The above-listed needs are met or exceeded by the present wash arm retainer for a warewasher, which features a housing for a reciprocating clamping cap, the housing having a sloping cam surface. A cap rod is slidably and rotatably engaged in the housing. An actuator handle secured through the cap rod to the clamping cap follows the cam surface between an extended, clamping position and a retracted, wash arm release position. The cam is provided with two distinct slope portions, including a first, relatively gradually inclined portion for exerting clamping force against the wash arm and a second, relatively steep portion for rapid clamping cap linear displacement. In addition, the cam preferably includes a locking formation for releasably retaining the actuator handle in the clamping position. As a further enhancement, an optional spring is provided for biasing the clamping cap to the release position for more rapid wash arm replacement. To reduce operational friction, the cap is preferably rotatable relative to the cap rod.

More specifically, the present invention provides a wash arm retainer for a warewasher having at least one wash arm with a plurality of nozzles and being in fluid communication with an adapter for receiving a flow of fluid. The retainer includes a housing defining a through bore, having a first end and a second end, and a cam surface formed in the housing and having a clamping position and a release position. A cap rod is slidably disposed in the through bore and is provided with an actuator handle projecting from the rod and constructed and arranged for following the cam surface.

In another embodiment, a wash arm retainer for a warewasher having at least one wash arm with a plurality of nozzles and being in fluid communication with an adapter for receiving a flow of fluid, includes a housing defining a through bore and having a first end and a second end, a cam surface formed in a wall of the housing and beginning at the first end, the cam surface having a first, gradually inclined portion, and a second, steeply inclined portion. A cap rod is slidably disposed in the through bore and is provided with an actuator handle projecting generally transversely from the rod and constructed and arranged for following the cam surface between a clamping position and a release position. A cap is secured to an end of the cap rod in operational proximity to the first end and is configured for engaging a complementary formation on the wash arm.

In yet another embodiment, a wash arm retainer for a warewasher having at least one wash arm with a plurality of nozzles and being in fluid communication with an adapter for receiving a flow of fluid, includes a housing defining a through bore and having a first end and a second end, and a cam surface formed in the first end and having a clamping position and a release position. A cap rod is slidably disposed in the through bore and is provided with an actuator handle projecting generally transversely from the rod and constructed and arranged for following the cam surface. A cap is rotatably secured to an end of the cap rod in operational proximity to the first end and is configured for engaging a complementary formation on the wash arm. A return spring is disposed in the housing, and the housing further includes a shoulder in the throughbore forming a stop for the return spring. The cap rod is provided at a free end with a spring retainer for holding the spring against the shoulder and being slidably engaged in the throughbore. The spring biases the cap rod to the release position.

DETAILED DESCRIPTION OF THE INVENTION

Figure 1:
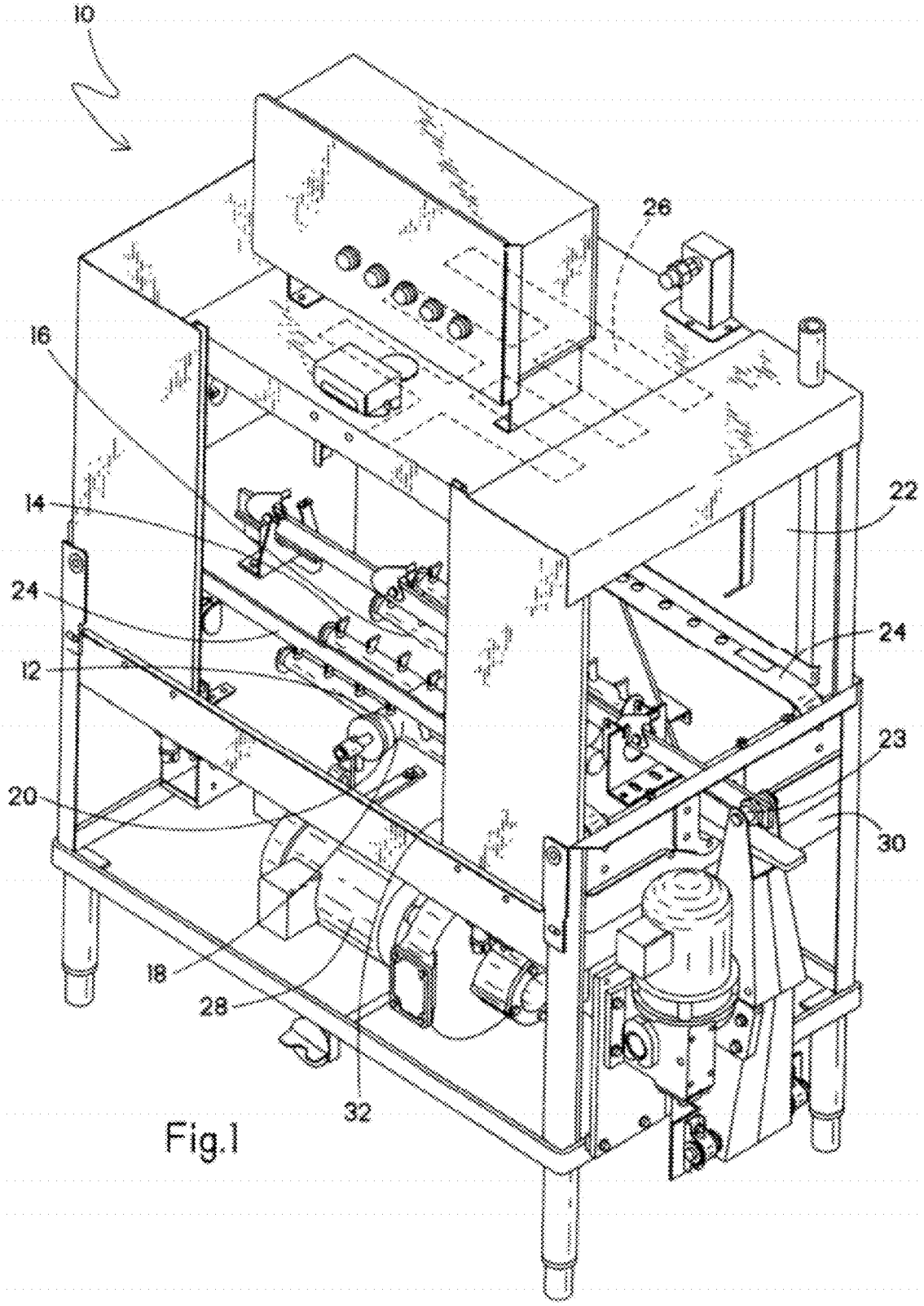
FIG. 1 is a top perspective view of a warewasher suitable for use with the present wash arm retainer.

Referring now to FIG. 1, a warewasher suitable for use with the present wash arm retainer is generally designated 10 and is of the type commonly referred to as a rack conveyor washer. This kind of unit is shown for illustrative purposes only, it being understood that the present wash arm retainer is useful with any kind of warewasher employing a removable wash arm, generally designated 12. As is known in the art, the wash arm 12 is tubular for forming a fluid transporting passageway, and is provided with a plurality of linearly spaced wash nozzles 14. Depending on the machine, such wash arms 12 may be provided with supplemental, laterally extending portions 16, forming a wash arm manifold. The wash arm 12 is hollow and features an end 18 that has a peripheral collar flange 20 and serves as the site for releasable connection to the present wash arm retainer.

It is common for warewashers 10 to employ recirculated detergent-laden water and/or tank rinse water. A pump recirculates the water through the wash arms 12, after which the water drains back into an open-topped tank. The term tank as presently used applies equally to a rinse tank in which previously used fresh rinse water is contained in a separate heated tank. In some machines, the ware is given a pumped pre-rinse prior to a final fresh water rinse.

The warewasher 10 encloses a wash/rinse chamber 22 through which racks of ware are intermittently moved by a conveyor mechanism 23 along tracks 24 between an upper wash arm 26 (shown hidden) and the lower wash arm 12, each of which is conventionally supplied with a plurality of the spray nozzles 14. A fluid, typically water is fed to the wash arms 12, 26 by means of a pump 28 which has a screened water intake and is passed through a conduit to the arms. The water intake is adjacent the bottom of a tank 30 which extends essentially the full length of the warewasher 10 as viewed in FIG. 1. At least one inspection door (not shown) is positioned in a gap 32 may expose the chamber 22 to an operator at the front of the machine if desired for any reason.

During normal operation, the water level will remain within one or two inches from the initial fill level, fluctuating within that range. As the pump 28 operates in a wash cycle, about four of five gallons of water are suspended in the pump 28, conduit, the wash arms 12, 26 and the chamber 22 as water is recirculated and drains back from the washed ware into the tank 30. When washing of a rack of ware is completed, the pump 28 shuts off and the water in suspension drains back into the tank 30, causing overflow of excess water and floating soil through the standpipe. The rack of washed ware is then conveyed past a hot fresh water final rinse line (not shown) while the next rack of ware is being moved into the wash chamber. The rinse water replenishes the water in the wash chamber 22, also causing floating soil to pass to drain. What has thus far been described is conventional in one type of warewasher and is described solely to place the invention in an environment in which it is used.

As described above, through operation, the wash arms 12, 26 become soiled with baked on food deposits, excess soap and the like, and require frequent removal for cleaning. In many applications, daily disassembly and cleaning is recommended. Conventional release mechanisms were either awkward to manipulate without tools, or became soiled themselves to the extent that their operation is impaired.

Figure 3:
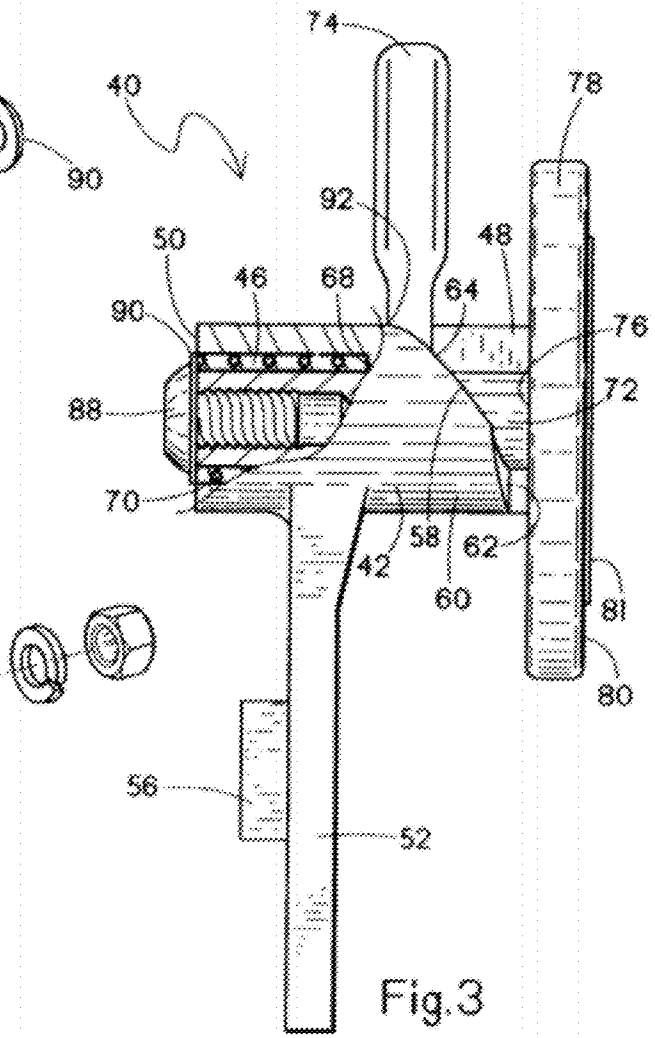
FIG. 3 is a side elevation of the present wash arm retainer, with portions shown cut away for clarity.
Figure 2:
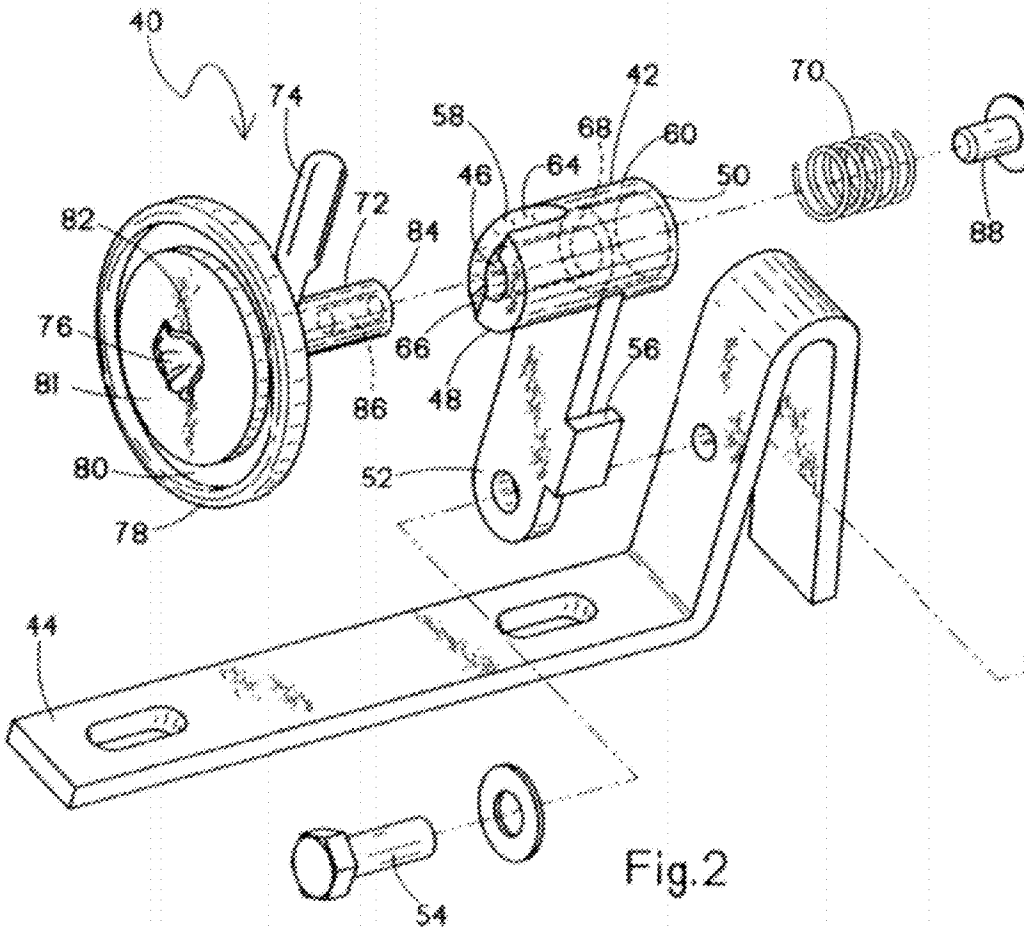
FIG. 2 is an exploded perspective view of the present wash arm retainer.

Referring now to FIGS. 2 and 3, the present wash arm retainer is generally designated 40 and addresses the drawbacks of the prior art devices. The retainer 40 includes a housing 42 configured for being mounted to a frame member or bracket 44 located in the wash/rinse chamber 22. A through bore 46 is defined in the housing 42 which has a first end 48 and a second end 50. A mounting arm 52 projects preferably normally from the housing and is configured for engaging the bracket 44, such as with a threaded fastener 54. The mounting arm 52 should be installed to the bracket 44 so that it is rotatable thereto, and the fastener 54 permits such rotation. This allows the retainer 40 to rotate out of the way for easier removal of the wash arm 12, 26. It is preferred that the mounting arm 54 is provided with at least one tab 56 for maintaining a proper, preferably vertical position of the mounting arm with the bracket 44 and preventing relative rotation of these components during installation of a cleaned wash arm 12, 26.

A main feature of the housing 42 is a cam surface 58 formed in a wall 60 of the housing at the first end 48. The cam surface 58 includes a first portion 62 with a relatively small incline or slope, and a second portion 64 with a relatively large incline or steep slope. Also, it is preferred that the first portion 62 is provided with a locking formation 66 (best seen in FIG. 2), which in the preferred embodiment is a locking notch. An optional annular shoulder 68 is defined within the through bore 46, and provides a seat for an optional biasing element 70, preferably a coiled return spring.

A cap rod 72 is slidably and rotatably engaged in the through bore 46, and is provided with an actuator handle 74 projecting preferably normally or transversely from the cap rod, but other angular orientations are contemplated. The actuator handle 74 is constructed and arranged for following the cam surface 58, and in so doing is linearly displaces the cap rod 72 relative to the housing 42. In the preferred embodiment, a cap end 76 of the cap rod 72 is provided with a disk-shaped cap 78. The cap 78 provides a clamping and plugging function for the wash arm 12, 26 and preferably has an annular groove 80 (FIG. 2) for accommodating the complementarily shaped flange collar 20, and a central plug or boss 81 which extends axially beyond a periphery of the cap 78 (FIG. 3). Also, the cap 78 is secured to the cap end 76, and is preferably rotatable relative to the cap end to facilitate the removal of the wash arm 12 as will be described below. In the preferred embodiment, this rotatability is obtained by the cap end 76 matingly engaging an axial opening 82 and being flared by a cone tool or peened over as is known in the art. Alternative structure is contemplated for achieving this rotatability, including, but not limited to the use of cotter pins or various styles of retaining rings.

In an alternate embodiment, the collar 20 has the cap 78 fixed thereto or is otherwise plugged, and the cap end 76 directly exerts a clamping force on the plugged end 18 of the wash arm 12. The movement of the cap rod 72 relative to the housing 42 between a retracted and a clamping position is the same whether or not the cap 78 is secured to the cap end 76.

Opposite the cap end 76, a spring end 84 of the cap rod 72 is axially bored and threaded to create a socket 86 for receiving a retainer, preferably a flanged fastener 88. The fastener 88 may be unitary or may be a fastener with a separate disk washer as is known in the art. An outer diameter of a flange 90 of the fastener 88 is tightly yet slidably dimensioned for engagement in the through bore 46. When provided, the coiled return spring 70 is axially engaged about the spring end 84 and held in place by the flanged fastener 88. Opposite the fastener 88, the spring 70 rests upon the shoulder 68.

Figure 4:
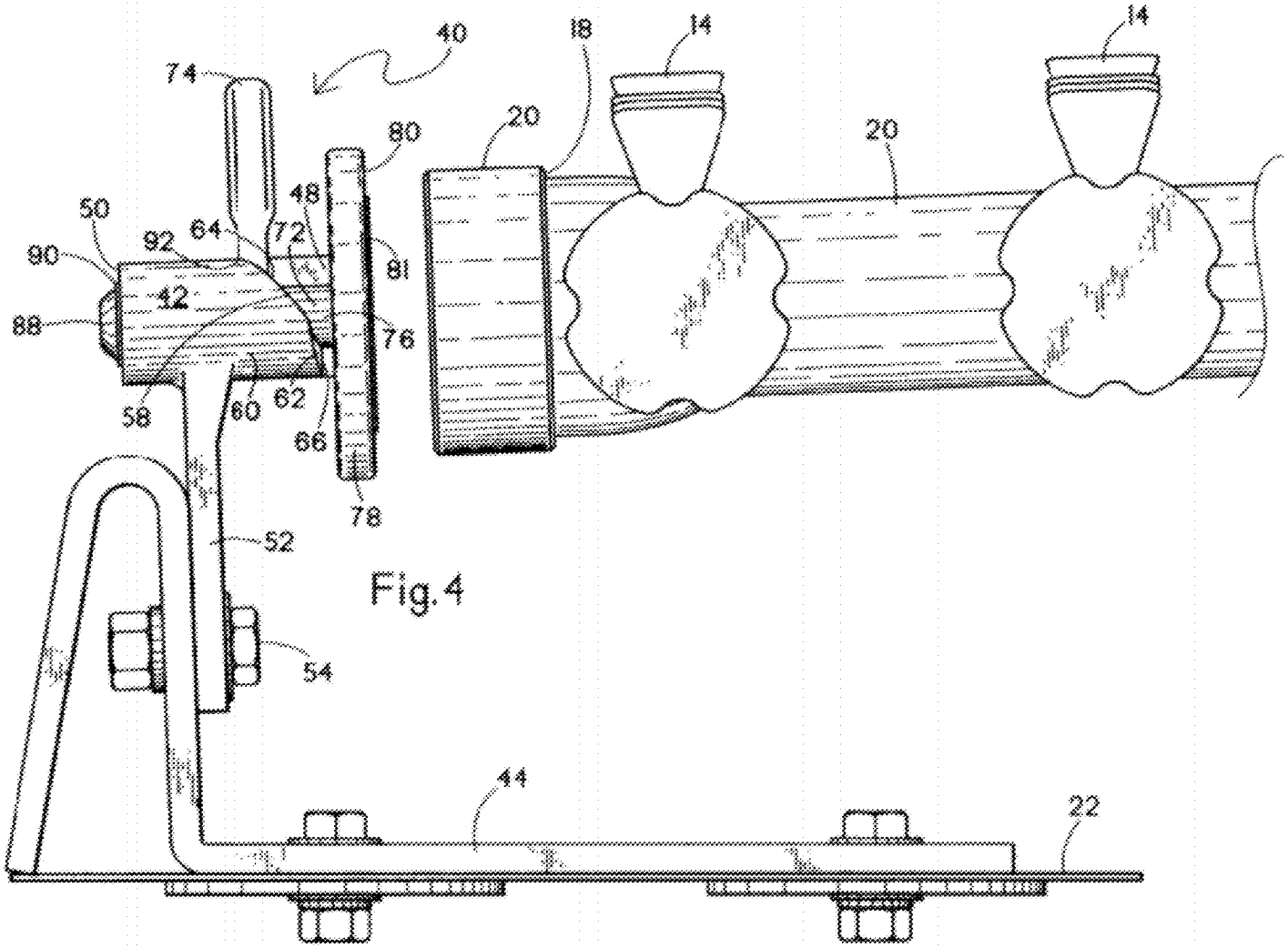
FIG. 4 is a side elevation of the present wash arm retainer shown in the release position relative to a warewasher wash arm.
Figure 5:
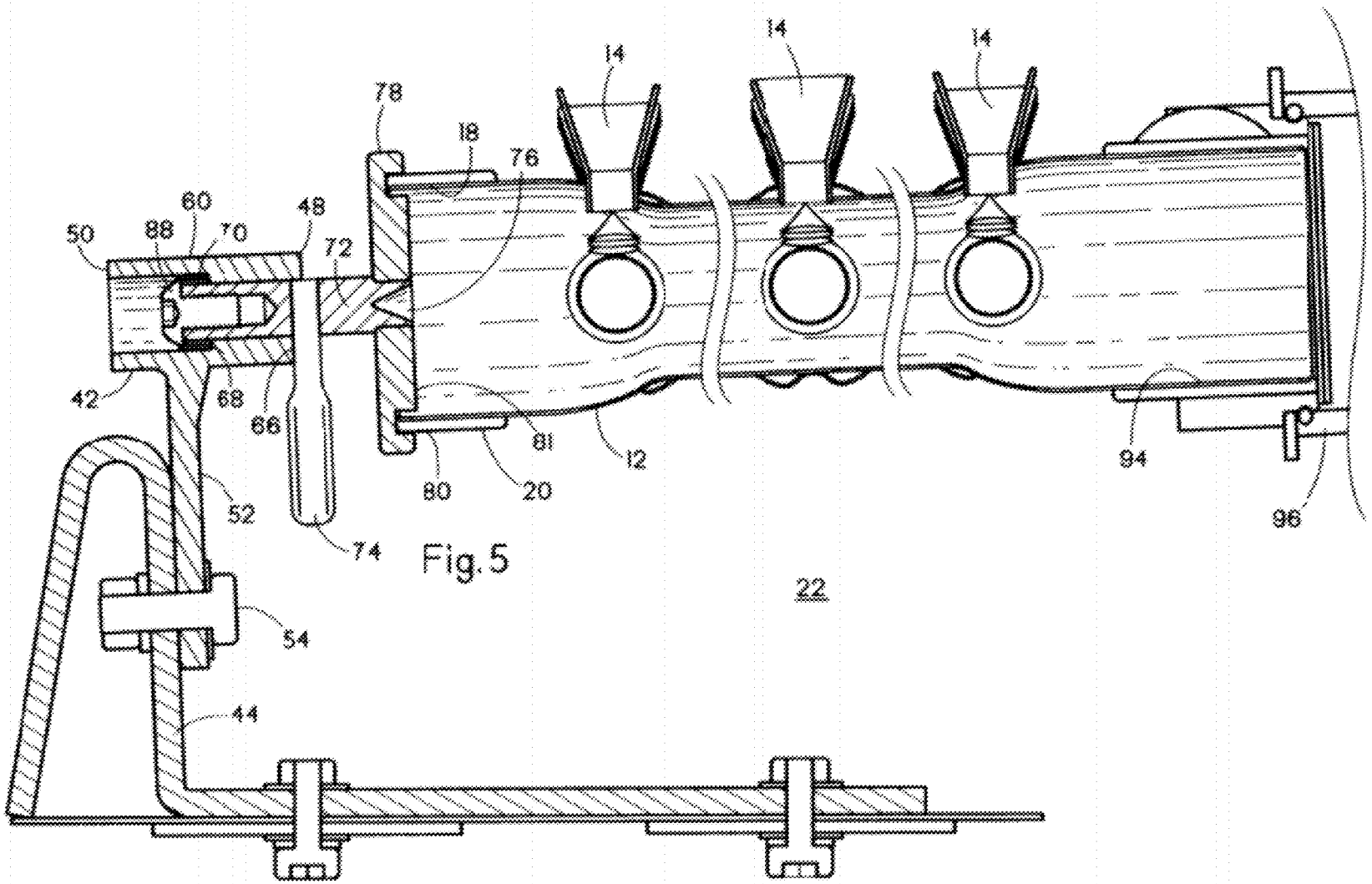
FIG. 5 is a side elevation of the present wash arm retainer shown in the clamping position relative to a warewasher wash arm.

Referring now to FIGS. 3-5, it will be seen that the actuator handle 74 follows the cam surface 58 between a clamping or extended position (FIG. 5) in which the handle is disposed at the locking formation 66, which forms a cap end of the first cam portion 62, and a release or retracted position (FIGS. 3 and 4) in which the handle is disposed at an opposite end 92 of the second cam portion 64. In traveling between the two positions, the actuator handle 74 is rotatably displaced 180°. Also, it will be seen that once the actuator handle 74 has engaged the full length of the second cam portion 64, there is a significant linear displacement of the cap 78, compared to the travel of the handle upon the first cam portion 62. Further, the second cam portion 64 defines the majority of the linear displacement of the cap rod 72 relative to the housing 42.

As seen in FIG. 4, when removal of the wash arm 12, 26 is required, the actuator handle 74 is moved to the release position. Once the cap rod 72 is in the retracted or release position, there is sufficient clearance between the cap 78 and the collar 20 for rotation of the wash arm retainer 40 about the fastener 54 and away from the wash arm to permit easy removal of the wash arm 12, 26. Also, when the return spring 70 is provided, it biases the cap rod 72 to the release position. Without the spring 70, the user merely physically moves the handle 74 to the release position. In addition, when in the clamped position (FIG. 5), the spring 70 holds the cap rod 72 in the locking formation 66. Further, the disposition of the spring 70 within the housing 42 and protected by the flanged fastener 88 protects the spring from operational grime, which was a problem in prior art.

Once the wash arm 12 has been cleaned and positioned, an opposite end 94 of the wash arm 12, 26 is matingly engaged in an adapter 96 from which the wash or rinse water emanates. The wash arm retainer 40 is then rotated to the vertical position shown in FIG. 5. The tab 56 engages the bracket 44 and prevents the housing 42 from rotating beyond a vertical position when actuating the handle 74 to engage the clamping action. Next, the actuator handle 74 is moved along the second portion 64 of the cam surface 58, which provides significant linear displacement. Upon reaching the first cam portion 62, the actuator handle 74 has traveled most of the way to the clamping position. The relatively gradual slope of the first cam portion 62 allows the user to provide a finer adjustment and a gradual application of clamping force as the wash arm 12 is moved into position. Simultaneously with the movement of the actuator handle 74, the user manipulates the wash arm 12, 26 so that the protruding plug 81 performs a locating function for guiding the collar 20 into the groove 80 on the cap 78. At least one border defining the groove 80 on the cap 78 is chamfered to facilitate this locating function.

Upon the wash arm reaching the operational position, the actuator handle 74 is received in the locking formation 66. At this point, as the handle 74 is moved toward the locking formation 66, the rotatablity of the cap 78 relative to the cap rod 72 reduces frictional load on the handle. While other materials are contemplated, it will be understood that the housing 42, the cap rod 72, the actuator handle 74 and the cap 78 are preferably made of stainless steel. The components are preferably produced by casting, however other fabrication techniques are contemplated.

While a particular embodiment of the present wash arm retainer for a warewasher has been described herein, it will be appreciated by those skilled in the art that changes and modifications may be made thereto without departing from the invention in its broader aspects and as set forth in the following claims.

The invention claimed is:

1. A wash arm retainer for a warewasher having at least one wash arm with a plurality of nozzles and being in fluid communication with an adapter for receiving a flow of fluid, comprising:

a housing defining a through bore and having a first end and a second end, said housing defining an outer surface and said first end including an edge that is transverse to said outer surface;

a cam surface formed on said edge of said first end of said housing and having a clamping position and a release position; and a cap rod extending along a longitudinal axis and slidably disposed in said through bore and provided with an actuator handle projecting transversely from said cap rod, said handle rotating about said longitudinal axis to rotatably, slidingly contact said cam surface while moving between a first handle position and a second handle position, such that said sliding contact between said handle and said cam surface causes said cap rod to move between said release position, in which said cap rod is retracted relative to said housing subject to a biasing force, and said clamping position, in which said cap rod is extended relative to said housing and is disposed at said first end edge to overcome said biasing force.

2. The wash arm retainer of claim 1 wherein said cam surface includes a first cam portion and a second cam portion, said first cam portion having a reduced slope and corresponding linear displacement relative to said second cam portion.

3. The wash arm retainer of claim 2 wherein said second cam portion is relatively steep and defines a majority of the linear displacement of said rod relative to said housing between said clamping position and said release position.

4. The wash arm retainer of claim 2 further including a locking formation at said first end edge, said locking formation being dimensioned to accommodate and retain said actuator handle in said clamping position.

5. The wash arm retainer of claim 1 wherein said cam surface is provided with a locking formation being dimensioned to accommodate and retain said actuator handle in said clamping position.

6. The wash arm retainer of claim 1 further including a biasing element for biasing said cap rod toward said release position.

7. The wash arm retainer of claim 6 wherein said housing defines a shoulder in said throughbore forming a stop for said biasing element.

8. The wash arm retainer of claim 7 wherein said biasing element is restrained between said stop and a retainer on an end of said cap rod.

9. The wash arm retainer of claim 1 further including a cap rotatably secured to an end of said cap rod in operational proximity to said first end and defining a groove configured for engaging a complementary formation on the wash arm.

10. The wash arm retainer of claim 9 wherein said cap is rotatably secured to said cap rod for free rotation relative to said rod.

11. The wash arm retainer of claim 9 wherein said cap includes a central plug bordered by a groove for accommodating an end of said at least one wash arm.

12. The wash arm retainer of claim 1 wherein said actuator handle projects normally from said cap rod.

13. The wash arm retainer of claim 1 wherein said actuator handle rotates approximately 180° from said clamping position to said release position.

14. The wash arm retainer of claim 1 further including a mounting arm projecting from said housing for mounting said housing to the warewasher.

15. A wash arm retainer for a warewasher having at least one wash arm with a plurality of nozzles and being in fluid communication with an adapter for receiving a flow of fluid, comprising:

a housing defining a through bore and having a first end and a second end, said housing defining an outer surface and said first end including a wall that is transverse to said outer surface;

a cam surface formed in said wall of said housing and beginning at said first end, said cam surface having a first, gradually inclined portion, and a second, steeply inclined portion;

a cap rod slidably disposed in said through bore and provided with an actuator handle projecting generally transversely from said rod, said handle slidingly contacting said cam surface while moving between a first handle position corresponding to a clamping position of said cap rod and a second handle position corresponding to a release position of said cap rod, such that said sliding contact between said handle and said cam surface causes said cap rod to move between said release position, in which said cap rod is retracted relative to said housing, and said clamping position, in which said cap rod is extended relative to said housing and said handle engages said transverse wall; and a cap secured to an end of said cap rod in operational proximity to said first end and defining a groove configured for engaging a complementary formation on the wash arm.

16. The wash arm retainer of claim 15 wherein said handle on said cap rod rotates 180° between said clamping position and said release position.

17. The wash arm retainer of claim 15 wherein said housing includes a shoulder in said throughbore forming a stop for a return spring, and said cap rod is provided at a free end with a spring retainer for holding said spring against said shoulder and being slidably engaged in said throughbore.

* * * * *